US008915462B2

(12) United States Patent
Meyer

(10) Patent No.: US 8,915,462 B2
(45) **Date of Patent: *Dec. 23, 2014**

(54) MANDREL CUPPING ASSEMBLY

(75) Inventor: Peter David Meyer, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 307 days.

This patent is subject to a terminal disclaimer.

(21) Appl. No.: 13/449,377

(22) Filed: Apr. 18, 2012

(65) Prior Publication Data

US 2013/0277491 A1 Oct. 24, 2013

(51) Int. Cl.
*B65H 19/00* (2006.01)
*B65H 67/00* (2006.01)

(52) U.S. Cl.
USPC ..... 242/559.1; 242/533.4; 242/533.5

(58) Field of Classification Search
USPC ..... 242/533.2, 533.4, 533.5, 533.6, 559.1, 242/559.2
See application file for complete search history.

(56) References Cited

U.S. PATENT DOCUMENTS

| | | | | | |
|---|---|---|---|---|---|
| 2,066,659 | A | * | 1/1937 | Clouse et al. | 242/571.8 |
| 2,082,031 | A | * | 6/1937 | Schultz et al. | 242/573.4 |
| 2,703,681 | A | * | 3/1955 | Jacobs | 242/555.5 |
| 2,769,600 | A | * | 11/1956 | Nystrand et al. | 242/530.1 |
| 3,063,347 | A | * | 11/1962 | Cummings | 493/106 |
| 3,289,552 | A | * | 12/1966 | Corazzo | 493/107 |
| 3,381,911 | A | * | 5/1968 | Held et al. | 242/527.3 |
| 3,599,892 | A | * | 8/1971 | Brouwer et al. | 242/559.2 |
| 3,613,571 | A | * | 10/1971 | Russell et al. | 101/40 |
| 3,635,415 | A | * | 1/1972 | Phelps et al. | 242/533.6 |
| 3,761,032 | A | * | 9/1973 | Bahnsen | 242/532.2 |
| 3,871,595 | A | * | 3/1975 | Smolderen | 242/527.4 |
| 4,266,735 | A | * | 5/1981 | Leanna et al. | 242/533.5 |
| 4,327,876 | A | * | 5/1982 | Kuhn | 242/527.4 |
| 4,516,742 | A | * | 5/1985 | Townsend | 242/533.5 |
| 4,588,138 | A | * | 5/1986 | Spencer | 242/533.6 |
| 4,635,871 | A | | 1/1987 | Johnson et al. | |
| 4,773,609 | A | * | 9/1988 | Steffen et al. | 242/559.1 |
| 4,871,124 | A | * | 10/1989 | Hugo et al. | 242/532 |
| 4,911,375 | A | * | 3/1990 | Knop | 242/596.6 |

(Continued)

FOREIGN PATENT DOCUMENTS

| | | |
|---|---|---|
| DE | 4116963 | 11/1992 |
| WO | WO96/38364 | 12/1996 |

OTHER PUBLICATIONS

U.S. Appl. No. 13/272,303, filed Oct. 13, 2011, Day, et al.
U.S. Appl. No. 13/272,310, filed Oct. 13, 2011, Day, et al.

(Continued)

*Primary Examiner* — Emmanuel M Marcelo
*Assistant Examiner* — Michael Gallion
(74) *Attorney, Agent, or Firm* — Peter D. Meyer

(57) ABSTRACT

A mandrel cupping assembly for releaseably engaging the unsupported ends of a plurality of mandrels supported on a web winding turret assembly is disclosed. Each of the mandrels is driven in a closed mandrel path about a web winding turret assembly axis. The mandrel cupping assembly has a cupping arm turret with a cupping arm turret central axis, a cupping arm cooperatively associated with each mandrel of the plurality of mandrels, and a first actuator for disposing the cupping arm from a hold-open position to a hold-closed position. Each of the cupping arms is disposed radially about the cupping arm turret and is carried in a radial orbital path about the cupping arm turret central axis while disposed in either of the hold-open position or the hold-closed position.

16 Claims, 6 Drawing Sheets

(56) References Cited

U.S. PATENT DOCUMENTS

| | | | | | |
|---|---|---|---|---|---|
| 4,993,652 | A | * | 2/1991 | Moeller | 242/527.3 |
| 5,330,116 | A | * | 7/1994 | Meyer | 242/533.2 |
| 5,417,382 | A | * | 5/1995 | Petitjean et al. | 242/527 |
| 5,435,501 | A | * | 7/1995 | Alexander et al. | 242/533.8 |
| 5,667,162 | A | * | 9/1997 | McNeil et al. | 242/533.4 |
| 5,725,176 | A | | 3/1998 | Vigneau | |
| 5,732,901 | A | * | 3/1998 | McNeil et al. | 242/533.4 |
| 5,845,867 | A | * | 12/1998 | Hould et al. | 242/527 |
| 5,899,404 | A | * | 5/1999 | McNeil et al. | 242/533.4 |
| 5,913,490 | A | * | 6/1999 | McNeil et al. | 242/533.4 |
| 5,934,602 | A | * | 8/1999 | Jendroska et al. | 242/533.6 |
| 6,129,304 | A | * | 10/2000 | Biagiotti | 242/530.1 |
| 6,354,530 | B1 | * | 3/2002 | Byrne et al. | 242/533.5 |
| 6,595,459 | B2 | * | 7/2003 | Hanson | 242/532.3 |
| 7,204,448 | B2 | * | 4/2007 | Heikaus | 242/533.4 |
| 7,536,763 | B2 | | 5/2009 | Offerhaus | |
| 8,783,598 | B2 | * | 7/2014 | Day et al. | 242/533.4 |
| 2003/0160127 | A1 | * | 8/2003 | Wojcik et al. | 242/531 |
| 2005/0077416 | A1 | * | 4/2005 | Heikaus | 242/533.4 |
| 2006/0124719 | A1 | * | 6/2006 | Mannlein | 229/403 |
| 2006/0137501 | A1 | * | 6/2006 | Damo | 83/277 |
| 2007/0278342 | A1 | * | 12/2007 | Harkins | 242/571 |
| 2008/0105776 | A1 | * | 5/2008 | Wojcik et al. | 242/366.3 |
| 2009/0134264 | A1 | * | 5/2009 | Simonelli et al. | 242/530.1 |
| 2010/0320307 | A1 | | 12/2010 | Pappas et al. | |
| 2013/0092784 | A1 | * | 4/2013 | Day et al. | 242/598.4 |

OTHER PUBLICATIONS

U.S. Appl. No. 13/272,312, filed Oct. 13, 2012, Day, et al.
PCT International Search Report, mailed Jul. 24, 2013, 9 pages.

* cited by examiner

MANDREL CUPPING ASSEMBLY

FIELD OF THE INVENTION

The present disclosure relates to automatic web rewinding machines where paper towel stock, bath tissue stock, or the like unwound from very large parent rolls is rewound into small individual rolls. In particular, the present disclosure relates to an apparatus that releaseably attaches a mandrel cup into and out of supporting engagement with the free end of a mandrel prior to the winding of the web material upon the mandrel and subsequently detaching the mandrel cup from the mandrel so that the wound web material can be removed from the mandrel for additional processing.

BACKGROUND OF THE INVENTION

Typical web rewinding machines provide a number of core supporting mandrels ranging anywhere from four to ten in number which are mounted on an indexingly rotatable turret. The mandrels extend parallel to the horizontal axis about which the turret rotates, and they are spaced at equal distances from the turret axis and at uniform intervals around that axis. By way of example, a typical six-mandrel turret moves through one-sixth of a revolution at each of its indexing movements and hence it carries each mandrel in turn to each of the six successive stations with a period of dwell at each station. By way of yet another example, an exemplary eight-mandrel turret moves through one-eighth of a revolution at each of its indexing movements and hence it carries each mandrel in turn to each of the eight successive stations with a period of dwell at each station. In any regard, it should be understood that the number of spindles disposed about any given turret used in a web rewinding machine would likely determine the number of successive stations in any such device.

In such a configuration, typically one station (sometimes called a first station) is a loading station at which a length of core stock is slid axially onto the mandrel. At the next station, the core stock has an adhesive or glue applied to the surface of the core. At the third station, the mandrel is brought up to winding speed. As the mandrel moves from the third to the fourth station, the web material is attached to the glued core disposed upon the mandrel for the beginning of the winding operation. Winding continues while the mandrel is at the fourth station. As the mandrel moves out of the fourth station, the web material is cut through across its width (or cross-machine direction) to sever it from the wound roll of web material (e.g., the source of the web material) and give it a new leading edge that is attached to a new core on the next mandrel moving into the winding station. At the fifth station, the rotation of the mandrel is decelerated to a stop, and at the sixth station a wound core or log is stripped off the mandrel. The mandrel then moves to the first station for a repetition of the cycle.

A conventional turret by which the mandrels are carried comprises a spider which is mounted for a rotation on a coaxial shaft that projects a substantial distance in one direction from the spider. The mandrels have rotating connections with the spider, and they project from it in the same direction as the turret shaft. The rotating connection of each mandrel with the spider must provide cantilevered support of the mandrel because when the mandrel is at the core loading station and the unloading station, the end of the mandrel that is remote from the spider has to be accessible to allow cores to be moved axially onto and off. It should be recognized that the mandrels tend to be heavy and very long—typically, 72 inches to 96 inches in length. Therefore, their free ends are typically supported whenever possible and certainly during winding.

To provide support of the free ends of the mandrels, there is conventionally an assembly of supporting arms or chucks on the end portion of the turret shaft that is remote from the spider. This is also known to those in the art as a mandrel cupping assembly. A mandrel cupping assembly is an assembly that is constrained to indexing rotation concurrent with the spider containing the individual mandrels. The mandrel cupping spider generally comprises a chuck arm (or cup) cooperatively associated with each mandrel. Each chuck arm is generally swingable about an axis which is near the turret axis and transverse thereto between a substantially radially extending closed position in which the free end of the chuck arm supportingly engages the free end portion of its associated mandrel and an open position in which the chuck arm is disengaged from its mandrel and is disposed in a more or less axial orientation alongside the turret shaft. Each chuck arm is operated automatically so that it is in its open position during loading and unloading of the mandrel and is in its closed position at least from the time the mandrel moves into the gluing station and moves out of the deceleration station mentioned supra.

In one embodiment, a conventional mechanism for actuating the mandrel supporting chuck arms is provided with a barrel cam that is fixed to the machine frame adjacent to the free ends of the mandrels and a lever and link arrangement for each chuck arm. Each arrangement is carried by the turret for rotation therewith and having a cam follower roller that rides in a groove in the periphery of the stationary barrel cam. Each chuck arm is actuated at appropriate times in consequence of indexing movement of the turret. The shape of the cam groove is provided so that the chuck arms move into engagement with their respective mandrels when the latter are generally adjacent the glue applicator wheels and retract when the mandrels move from the web material winding position.

In such an operation, the stripping of wound rolls off a mandrel is conventionally accomplished by means of a pusher that engages the log at only one side of the mandrel and provides a lateral force upon the cantilevered mandrel. This can set the mandrel into a vibration mode that may be aggravated by the indexing movement that follows unloading. With the mandrel unsupported at the loading station, its free end often wobbles so severely that the core may not be run onto it with automatic core loading equipment. Such an apparatus is described in U.S. Pat. No. 2,769,600.

It is believed that with such conventional machines, the failure to load a core creates a danger that the mandrel itself would be coated with glue at the gluing station necessitating a lengthy shutdown of the machine for cleaning. An operator, seeing that such an unloaded core was moving out of the unloading station, would be required to stop the machine and would find that there is no way to retract the chuck arm engaged with the empty mandrel to permit manual axial unloading of the core. This is because of the nature of the chuck arm actuating mechanism. One purported solution to this problem was to slit a core along its length and push it laterally onto a mandrel to protect the mandrel from glue. At the conclusion of the winding cycle the individual rolls wound onto the slitted core are then discarded.

It is also believed that wobble of an unsupported mandrel could cause a chuck arm to fail to engage the mandrel properly. One solution proposed was a U-shaped member on each chuck arm that tended to preliminarily engage the mandrel during closing movement of the chuck arm and steady the mandrel sufficiently to enable its conical free end to be received in the bearing socket disposed in the chuck arm. However, it is believed that this expedient is not always successful in practice because as the wobbling mandrel fails to enter the chuck arm socket, the chuck arm mechanism exerts as much force as the indexing mechanism can provide. This can result in the inevitable bending or breakage of the link and lever elements that translate any cam follower motion into swinging motion of the chuck arm. The repair of such damage would be necessarily difficult and time consuming.

It is also believed that another expedient that has been used to prevent damage to the chuck arm actuating mechanism is to mount the barrel cam for limited axial motion and pneumatically bias it towards one limit of such motion. When a chuck arm fails to close properly, the reaction force that is imposed upon the cam moves it against its bias to a position which actuates an emergency stop. However, it is believed that such an emergency shutdown arrangement merely relieves some of the effects of the problem rather than solving the problem itself. By way of example, it will not permit axial loading of a core onto an empty mandrel that had moved out of the loading position.

Other solutions provide an automatic web rewinding machine or an automatic mandrel chucking mechanism that does not employ force derived from the turret indexing to affect chuck arm actuation. The chuck arms move to and from their mandrel supporting positions only during periods of dwell to minimize the likelihood of mandrel vibration at the time chuck arm closing occurs. The mechanism is arranged to allow a chuck arm to be manually controlled for movement to its open position in any position of the turret so that a core can be axially loaded onto an empty mandrel or a defective core or roll can be axially stripped off the mandrel. Such a system is described in U.S. Pat. No. 4,266,735.

In any regard, attempts by the prior art to achieve an automatic web rewinding machines all provide for a single chuck arm and it associated equipment to be cooperatively associated with a respective mandrel. Further, the chuck arm and its associated equipment must cooperatively rotate with the mandrel about the turret axis. In other words, a chuck arm is constrained to rotate with the turret and is movable relative to and between a closed position (in which the chuck arm supportingly engages the other end of the mandrel) and an open position (in which the chuck arm is disengaged from the mandrel) to permit cores to be moved axially onto and off it. Clearly, the mechanism is unduly complex and requires numerous moving parts and associated ancillary equipment for it to perform its intended function.

Thus, it would be clearly advantageous to provide a turret system and in particular, a mandrel cupping assembly that is less complex and requires fewer moving parts to perform its intended function. In fact, such system would rotate only the mandrel cup with its respective mandrel free of any associated equipment necessary to load and unload the mandrel cup. Clearly, such systems would be appreciated by one of skill in the art because of their overall simplicity and ease of use.

SUMMARY OF THE INVENTION

An exemplary embodiment of the present disclosure provides a mandrel cupping assembly for releaseably engaging the ends of a plurality of mandrels supported on a web winding turret assembly having a web winding turret assembly axis. Each of the mandrels is driven in a closed mandrel path about the turret assembly axis. The mandrel cupping assembly has a cupping arm turret with a cupping arm turret central axis, a cupping arm cooperatively associated with each mandrel of the plurality of mandrels, and a first actuator for disposing the cupping arm from a hold-open position to a hold-closed position. Each of the cupping arms is disposed radially about the cupping arm turret and has a mandrel cup for releaseably engaging the unsupported end of the mandrel. Each cupping arm is carried in a radial orbital path about the cupping arm turret central axis while disposed in either of the hold-open position or the hold-closed position.

DETAILED DESCRIPTION OF THE INVENTION

Figure 1:
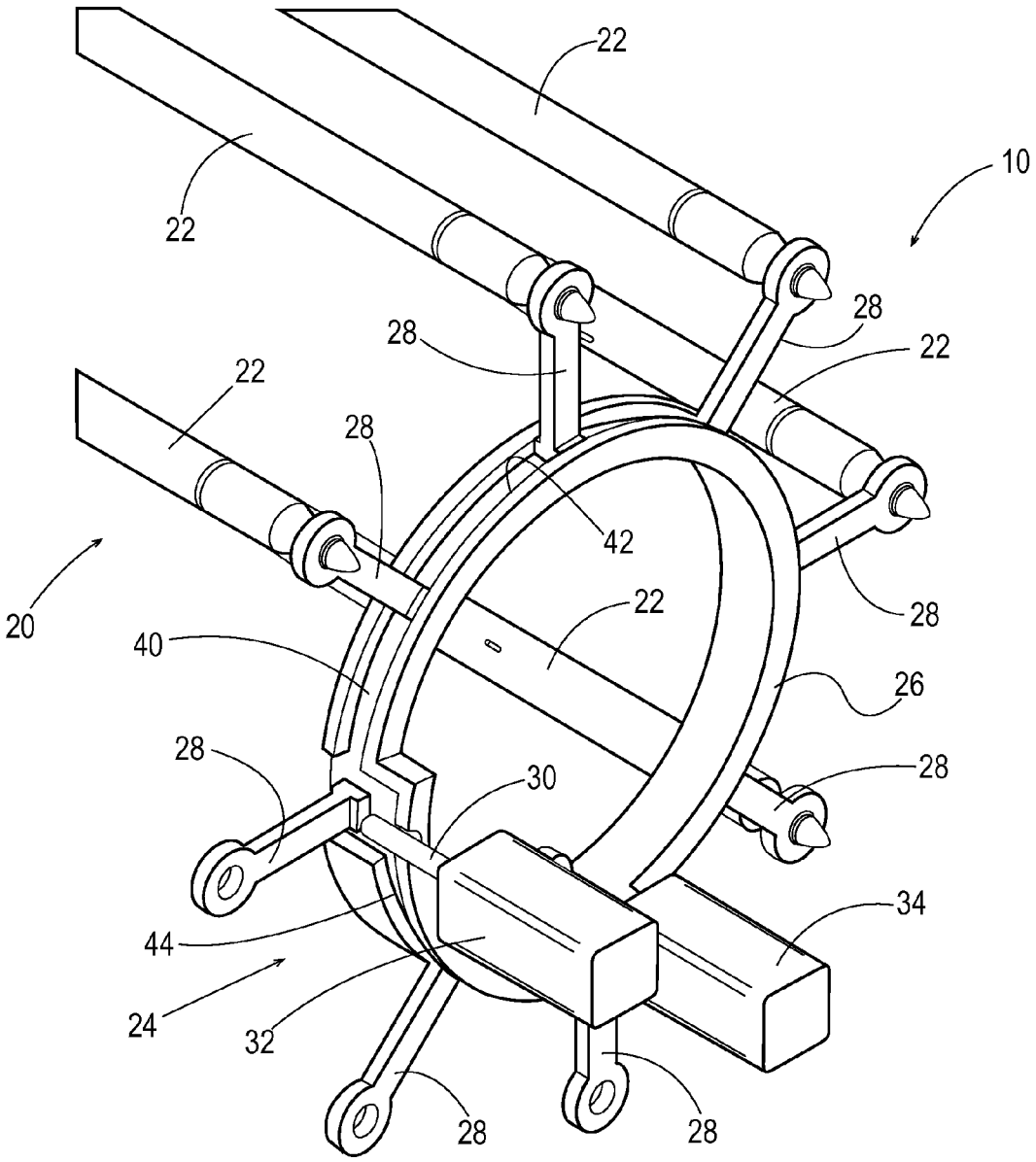
FIG. 1 is a partial perspective view of an exemplary web rewinding machine showing five exemplary mandrels and utilizing an exemplary mandrel cupping assembly.
Figure 2:
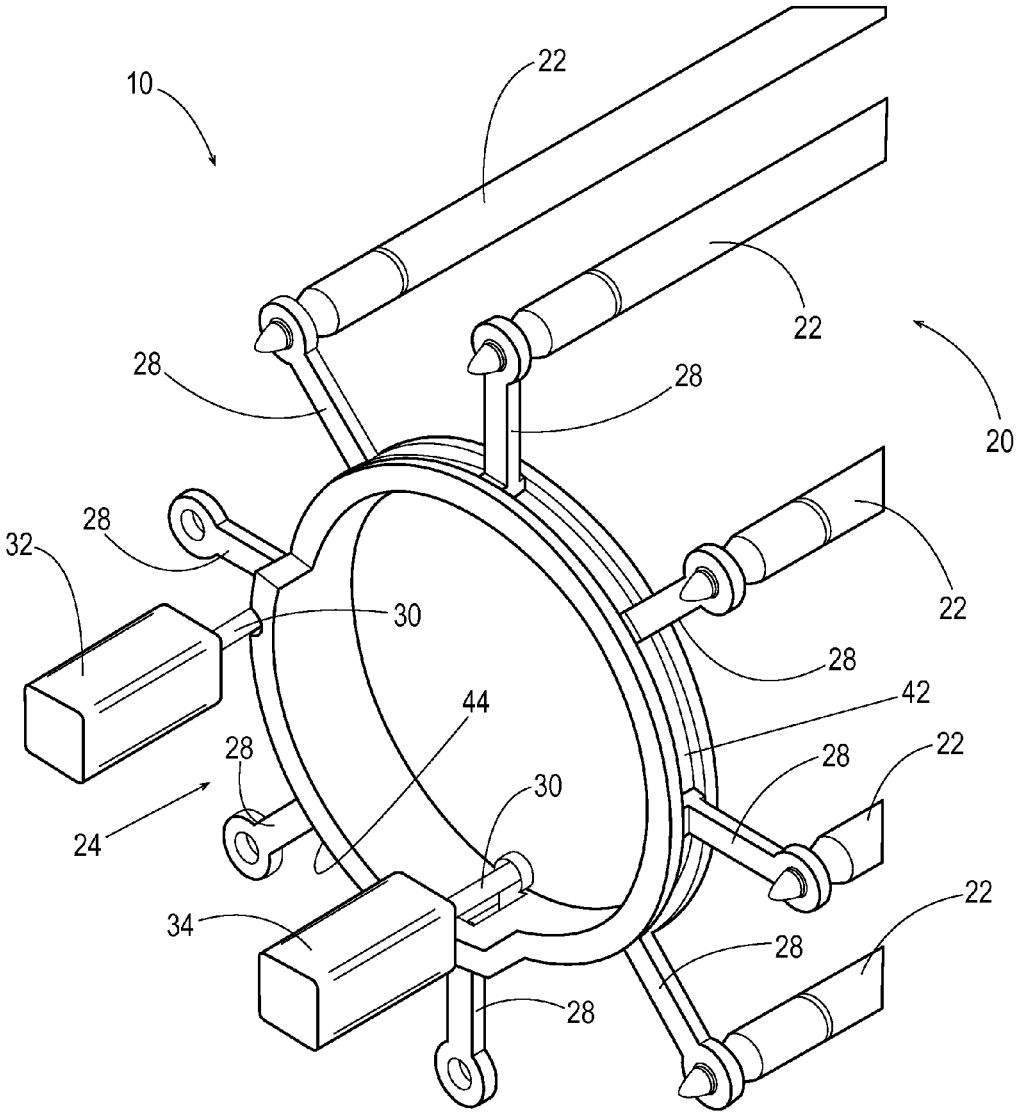
FIG. 2 is an alternative perspective view of the exemplary web rewinding machine of FIG. 1.
Figure 3:
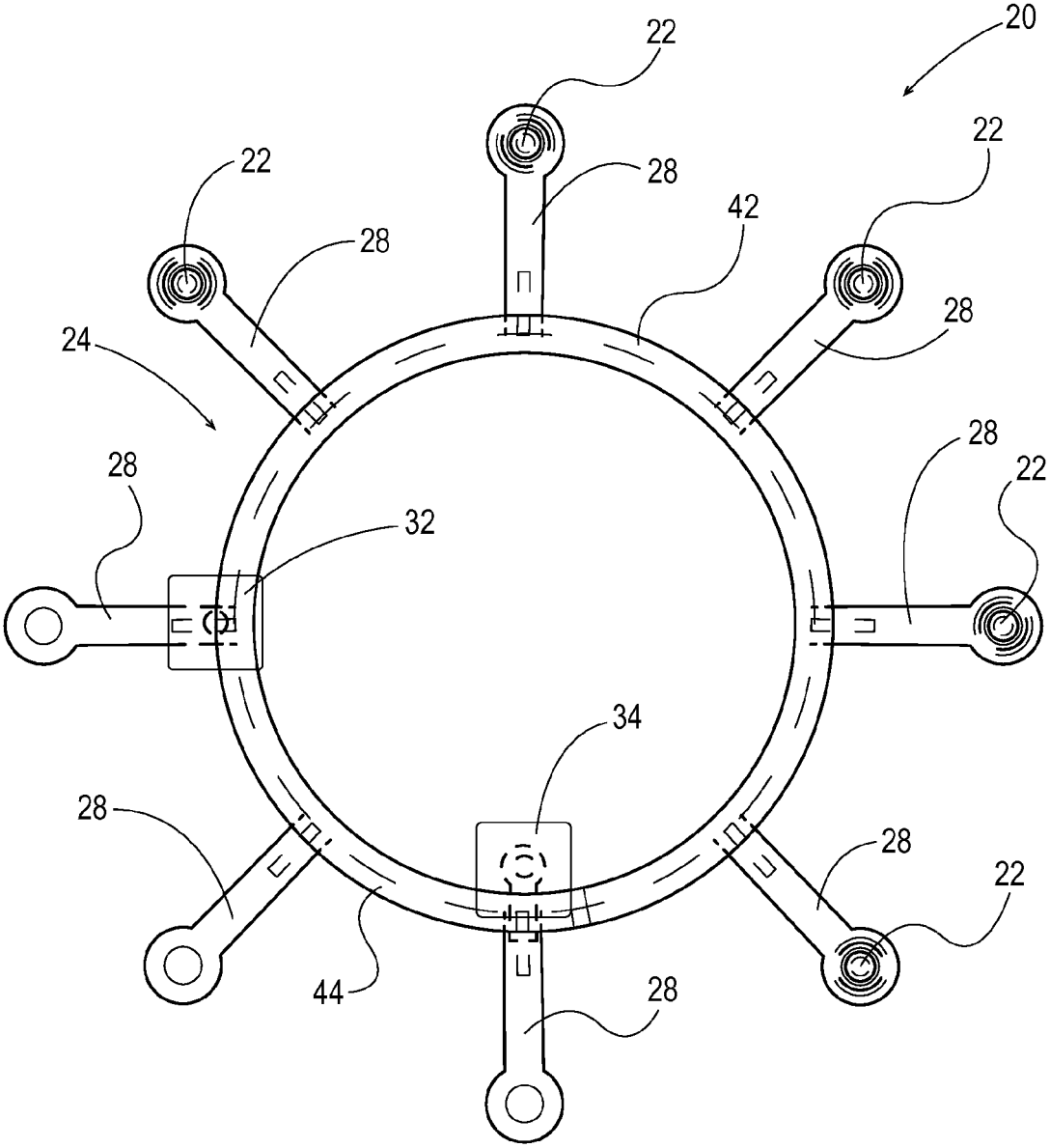
FIG. 3 is a planar end view of the exemplary mandrel cupping assembly shown in FIG. 1.

FIGS. 1-3 of the present disclosure depict various perspective and planar views of an exemplary web rewinding machine 10 and the relevant portion of an exemplary, non-limiting embodiment of a turret assembly 20 suitable for use as an automatic web rewinding machine. As would be appreciated by one of skill in the art, a plurality of rotatable core supporting mandrels 22 are carried in an indexable, orbital motion about the axis of turret assembly 20 as well as for rotation about their own respective axes. A turret assembly 20 of the present disclosure provides a spider (not shown) by which the respective mandrels 22 are carried and a shaft (not shown) by which the spider (not shown) is supported for rotation. The turret shaft (not shown) projects a substantial distance in one direction from the spider (not shown) and the mandrels 22 disposed thereupon project from the spider (not shown) a somewhat smaller distance in the same direction. One of skill in the art will appreciate that since the rotatable connection between the spider (not shown) and each of the long, relatively heavy mandrels 22 is near one end of the mandrel 22 and the other end of the mandrel 22 will be unsupported at times, the spider (not shown) will typically be provided with two axially spaced apart bearings (not shown) for each mandrel so that the cantilevered connection of the mandrel 22 with the spider (not shown) can, by itself, hold the mandrel 22 reasonably steady. As will be appreciated by one of skill in the art, it is preferred that each mandrel 22 be provided equidistant from the axis of the turret and are uniformly spaced about that axis.

Each mandrel 22 can be driven to provide the required rotation in any conventional manner. One form of a mandrel drive apparatus can provide rotation of each mandrel 22 and its associated core disposed thereabout the mandrel axis during movement of the mandrel 22 and core combination. The mandrel drive apparatus can provide winding of a web material upon the core supported on the mandrel 22 to form a log of web material wound around the core (a web wound core). This form of mandrel drive apparatus can provide center winding of the web material upon the cores (that is, by connecting the mandrel with a drive which rotates the mandrel 22 about its axis, so that the web material is pulled onto the core.

The mandrel 22 can be provided with a profiled rotation that provides a constant rotational speed throughout the winding cycle. Alternatively, the mandrel 22 can be provided with a winding profile that provides a differential rotational speed throughout the winding cycle.

As one of skill in the art will appreciate, each mandrel 22 can be connected at its end adjacent to the spider (not shown) with a form of coaxial clutch that provides a disengageable driving connection between the mandrel 22 and a coaxial sheave. Typically, the sheave is connected by means of a belt with a pulley and is rotatable on the turret shaft and in turn a belt drivingly connects the pulley with a motor which can be provided at a fixed location relative to the frame of the turret assembly 20. Such assemblies are described in U.S. patent application Ser. No. 06/113,465.

Further, one of skill in the art will appreciate that a turret assembly 20 having a turret (not shown) is typically indexingly rotated to carry each of the mandrels 22 to each of a succession of fixed stations at each of which the mandrel dwells for a time during the performance of an operation distinctive to the particular station. The arrangement of the stations, the operation or operations at each, and the apparatus provided at the several stations for the performance of their function are all generally known to those of skill in the art familiar with web rewinding machines.

In one exemplary, but non-limiting embodiment, each mandrel 22 can be provided with a toothed mandrel drive pulley 38 and a smooth surfaced, free wheeling idler pulley, both disposed near the at its end adjacent to the spider (not shown). The positions of the drive pulley and idler pulley alternate on every other mandrel 22, so that alternate mandrels 22 are driven by their respective mandrel drive belts. For instance, when a mandrel drive belt engages the mandrel drive pulley on its associated mandrel 22, the mandrel drive belt can ride over the smooth surface of the idler pulley on that same mandrel 22, so that only the respective drive motor provides rotation of that mandrel 22 about its axis. Similarly, when the mandrel drive belt engages the mandrel drive pulley on an adjacent mandrel 22, the mandrel drive belt can ride over the smooth surface of the idler pulley on that respective mandrel 22, so that only that drive motor provides rotation of the mandrel about its axis. Accordingly, each drive pulley on an associated mandrel 22 engages one of the belts to transfer torque to the mandrel, and the idler pulley engages the other of the belts, but does not transfer torque from the drive belt to the mandrel.

As would also be understood by one of skill in the art, a length of tubular core stock from a supply thereof is advanced axially by known mechanisms to be loaded onto a particular mandrel 22. Typically, a mandrel 22 has a conical or "bullet"-shaped nose free end portion to assist in guidance of the cores into a coaxial relationship thereto.

Similarly, after the winding of a web material into a wound product 46 upon a core disposed upon an associated mandrel 22, it was found that a generally conventional mandrel unloading mechanism can provide the individual rolls of wound product to be stripped off a particular mandrel 22 at an unload station. In one embodiment, the unloading mechanism may comprise an endless belt arranged to have a long, straight stretch which extends parallel to the mandrel 22 at the unloading station at a small distance to one side of that mandrel 22. A pusher can be secured to the belt and can project laterally therefrom to engage from behind a log of wound product 46 and drive it off the mandrel 22 as the pusher moves away from the spider along a straight stretch.

Alternatively, a core stripping apparatus can be positioned along the unload station. An exemplary core stripping apparatus can comprise a driven core stripping component, such as an endless conveyor belt. The conveyor belt preferably carries a plurality of flights spaced apart on the conveyor belt. Each flight can engage the end of a log supported on a mandrel 22 as the mandrel 22 enters the unload station.

A flighted conveyor belt can be angled with respect to a respective mandrel 22 axis as the mandrels 22 are carried along a generally straight line portion of the core unload station so that the flights engage each log disposed about a mandrel 22 with a first velocity component generally parallel to the mandrel 22 axis, and a second velocity component generally parallel to the straight line portion of the unload station. Once the log is stripped from the respective mandrel 22, the mandrel 22 can be carried along the closed mandrel path to the core loading station to receive another core.

As shown generally in FIGS. 1-3, one of skill in the art will recognize that during both unloading and loading of a mandrel 22, the end of a mandrel 22 that is remote from the spider must be unsupported. However, as the mandrel 22 moves through the portion of its orbit about the axis of turret assembly 20 that takes it from the loading station around to an unloading station, its free end portion is preferably supported by means of a cupping assembly 24 having cupping arms 28 disposed about a cupping spider 26 that are placed into contacting and un-contacting engagement with the free end of the mandrel 22. In other words, a cupping arm 28 releaseably engages the unsupported end of a mandrel 22 and supports the mandrel 22 for rotation of the mandrel 22 about its own rotational axis as well as its rotation (i.e., orbit) about the axis of turret assembly 20. In this embodiment, the cupping arm 28 is in a passive configuration for movement (i.e., orbit) about cupping spider 26. In a passive configuration, it is envisioned that the inertia of a particular spindle 22 due to its rotation about the axis of turret assembly 20, once in mating engagement with a corresponding cupping arm 28, will be sufficient to cause the corresponding cupping arm 28 to orbit about cupping spider 26 in a cooperative manner coincident with the mandrel 22 cooperatively associated thereto.

In a preferred embodiment, a particular cupping arm 28 is cooperatively associated with each mandrel 22. A cupping arm 28 of mandrel cupping assembly 24 releaseably engages the unsupported end of a mandrel 22 intermediate the core loading segment and the core stripping segment of the closed mandrel path as the mandrels 22 are driven around the turret assembly (not shown) axis by the rotating turret assembly (not shown).

In certain embodiments, when a turret assembly comprises four mandrels 22, naturally there will be four cupping arms 28 disposed radially about cupping spider 26—each cupping arm 28 providing cooperative engagement with each respective mandrel 22. Similarly, a turret assembly 20 having six, eight, or ten mandrels 22 disposed thereabout, a cupping assembly 24 will have respectively six, eight, or ten respective cupping arms 28 disposed radially about cupping spider 26.

In any regard, each mandrel 22 associated with the turret assembly (not shown) is provided with a corresponding cupping arm 28 that is disposed radially about cupping spider 26 of cupping assembly 24. Each cupping arm 28 orbits about cupping spider 26 in a cooperative motion with a respective mandrel 22. Such rotary motion carries a respective cupping arm 28 to rotate or orbit about the axis of cupping assembly 24 in a singular track 40. As used herein a "track" is to be broadly construed to provide a path or line for travel or motion for sliding or rolling a part or parts. As such, a "track" may include any device, apparatus, or assembly that prevents the unwanted movement from one portion of a device or assembly to another. Non-limiting examples of various tracks may include a race, a cam, a trace, a channel, groove, a rail, or the like all of which are used interchangeably and combineably herein without limitation.

It should be noted that track 40 is capable of providing the cupping arm 28 in a "closed" operative position in which the respective cupping arm 28 supportingly engages the free end portion of a cooperatively associated mandrel 22 of the turret assembly (not shown) and extends substantially radially to the shaft supporting the turret assembly (not shown). Further, the track 40 is capable of facilitating orbital motion of each cupping arm 28 about cupping assembly 24 in an "open" position in which the cupping arm 28 is disengaged (i.e., in non-contacting engagement) from its respective mandrel 22 cooperatively associated thereto.

Generally, cupping arm 28 remains in a radially up-right position relative to track 40 when in contacting engagement with a respective mandrel 22 of turret assembly (not shown). In a preferred embodiment, when cupping arm 28 is not in contacting engagement with a respective mandrel 22 of turret assembly (not shown), cupping arm 28 remains in a radially up-right position relative to track 40. However, it should be realized that cupping arm 28 may reside in any position relative to track 40 including any position that is disposed radially away from a respective mandrel 22 when cupping arm 28 is not in contacting engagement with a respective mandrel 22. Such an embodiment may relieve the need for offsetting the hold-open portion 44 of track 40 from the hold-closed portion 42 of track 40 as shown. In this way track 40 can be provided as a singular track 40 having a generally constant distance from the turret supporting the mandrels 22.

Each cupping arm 28 is generally provided with a ring at an end distal from cupping spider 26 and preferably comprises a bearing socket in which the generally conical end portion of the mandrel 22 is receivable. The ring can provide locking engagement with the unsupported end of mandrel 22. Such locking engagement can be provided through the use of locking pins, a 'snap-lock', magnets, gears, deformable rings, and the like. In any regard, it is preferred that the unsupported end of a corresponding mandrel 22 be capable of rotation within the engaged portion of cupping arm 28 while not being able to withdraw from the 'locked' position while the cupping arm 28 is in the hold-closed portion 42 of track 40.

The disposition of each cupping arm 28 into contacting or non-contacting engagement with a respective mandrel 22 is defined by cupping actuator 32 or un-cupping actuator 34, respectively, through a respective chucking lever 30. It is surprising to note that the cupping assembly 24 of the present disclosure only requires the use of only two actuators in order to provide engagement and disengagement of a respective cupping arm 28 with a mandrel 22 cooperatively associated thereto. It is also important to understand that the cupping actuator 32, the un-cupping actuator 34, and the associated ancillary equipment such as the respective chucking lever 30 of the present cupping assembly 24 do not rotate with a respective cupping arm 28.

The cupping assembly 24 is designed to be utilized with a single cupping actuator 32 and a single un-cupping actuator 34 that transfers each respective cupping arm 28 from the hold-open portion 44 of track 40 to the hold-closed portion 42 of track 40 and from the hold-closed portion 42 of track 40 to the hold-open portion 44 of track 40 respectively. In a preferred but non-limiting embodiment, the respective cupping actuator 32 or un-cupping actuator 34 can push/pull on a linkage cooperatively associated with the respective cupping arm 28. Alternatively, the respective cupping actuator 32 or un-cupping actuator 34 can push/pull directly upon cupping arm 28 upon engagement of the cupping actuator 32 or un-cupping actuator 34 directly upon cupping arm 28. Hold-open portion 44 of track 40 can provide a region suitable for the removal of the respective cupping arm 28 from the respective mandrel 22 and to provide the clearance necessary to facilitate removal of the material (e.g., core, core and material, etc.) disposed upon mandrel 22.

One of skill in the art will readily appreciate the fact that using only two actuating devices (cupping actuator 32 and un-cupping actuator 34) greatly reduces the need for having a respective activation device for each cupping arm 28 that may be associated with a cupping assembly of the prior art. Further, it will be readily appreciated by one of skill in the art as clearly advantageous in having such a cupping assembly 24 having only two actuating devices (cupping actuator 32 and un-cupping actuator 34) in that such a system can allow cupping and un-cupping actions to occur at virtually any point of the rotation of turret assembly 20 as well as the respective cupping arms 28 orbiting about cupping assembly 24. This can include, but clearly not be limited to, turret assembly 20 dwell, turret assembly index, or any combination of the two. This is clearly advantageous over conventional cam track systems that require cupping and un-cupping actions to occur only while the turret is in motion. Clearly, one of skill in the art will appreciate that the system of the present invention provides less complexity by allowing increased product turn-over rates, reduced maintenance and repair times, as well as reduced maintenance and repair costs.

Referring to FIGS. 1 and 2, an incoming cupping arm 28 (i.e., a cupping arm 28 not engaged with a mandrel 22) generally rides in hold-open portion 44 of track 40. In a preferred embodiment and as shown in FIGS. 1-3, the section of track 40 comprising hold-open portion 44 can generally be off-set from the section of track 40 comprising hold-closed portion 42. This ensures that the respective cupping arm 28 remains in the un-cupped position and remains distal from a corresponding mandrel 22. One of skill in the art will appreciate that the cupping arm 28 should be in a fully retracted position before the cupping arm 28 proceeds past the position where the cupping actuator 32 via its chucking lever 30 engages the cupping arm 28. This engagement between the respective chucking lever 30 and cupping arm 28 causes cupping arm 28 to be positioned in hold-closed portion 42 of track 40 and thus in contacting engagement with the unsupported end of a respective mandrel 22. In a preferred embodiment, the cupping arm 28 eventually reaches a dwell position in hold-open portion 44 of track 40 where the cupping arm 28 is fully retracted. In such a dwell position, a core can be loaded onto the respective mandrel 2. Then the cupping arm 28 can be directed inwardly toward the open end of the mandrel 22 in order to close the cup and fully support the previously unsupported end of the mandrel 22. The geometry and/or location of hold-open portion 44 of track 40 is preferably designed to allow the turret assembly 20 to cup during dwell, turret index, or any combination of the two. Practically, it was found that this design allows more time to load a core onto a respective mandrel 22 and also facilitates higher turret assembly 20 turn-over speeds. The cupping arm 28 can begin to retract once the cupping arm 28 reaches a clear-out position. In this position, it is preferred that the cupping arm 28 be in a fully retracted position before the next incoming cupping arm 28 approaches a clear in position.

One of skill in the art will appreciate that cupping arm 28 could comprise a feature that utilizes the cupping motion to actuate means for locking a core onto respective mandrel 22. By way of non-limiting example, the cupping motion may cause axial compression of a deformable ring disposed at the cupping end of respective mandrel 22. This compression forces the ring to expand radially, thereby locking the core onto respective mandrel 22. Further, the core can also be driven onto a core stop disposed proximate to the spider (not shown) end of turret assembly (not shown) prior to cupping. The core stop can be provided with tapered fins that are effectively wedged into the core wedged when loading. Effectively, such a tapered stop and expanding ring can combine to lock the core onto the respective mandrel 22 at both ends, providing a non-slipping drive engagement.

In another alternative, but non-limiting embodiment, the cupping motion could displace a moveable shaft disposed within the respective mandrel 22. Axial movement of the shaft would then cause locking pins disposed within respective mandrel 22 to protrude outside the outer diameter of the respective mandrel 22, thereby locking the core to the respective mandrel 22.

Referring again to FIGS. 1 and 2, when the cupping arm 28 reaches the start of hold open portion 44 of track 40, the un-cupping actuator 34 through chucking lever 30 engages cupping arm 28 and retracts to essentially un-cup the mandrel 22 and leave the end of the mandrel 22 unsupported. While the mandrel 22 is un-cupped in this position, the wound product (which now forms what is known to those of skill in the art as a log) can be stripped from the respective mandrel 22. The track 40 and cupping arm 28 geometry and location is preferably designed to allow the turret assembly to un-cup during dwell, turret assembly index, or any combination of the two. The turret assembly (not shown) then begins to index and the un-cupping actuator 34 and chucking lever 30 begin to extend once the cupping arm 28 disposed within the hold-open portion 44 of track 40 reaches a clear-out position.

In a preferred embodiment, the hold-open portion 44 of track 40 is designed to maximize time to strip the log comprising wound product from the mandrel 22 and to maximize turn-over for the placement of a new core upon mandrel 22. One of skill in the art will understand that the un-cupping actuator 34 and associated chucking lever 30 should be in the fully extended position before the next incoming cupping arm 28 disposed within the hold-closed portion 42 of track 40 gets beyond a clear-in position.

In a preferred embodiment, both cupping actuator 32 and un-cupping actuator 34 are provided as linear motors. However, one of skill in the art will understand that it would also be possible to provide an embodiment of the cupping assembly 24 where the cupping actuator 32 and un-cupping actuator 34 are provided as a four-port, two-position valve having an axially slideable valve element. In such an embodiment, both cupping actuator 32 and un-cupping actuator 34 can be operated by the use of compressed air or any other fluid suitable for use in such constructions. By providing cupping actuator 32 and un-cupping actuator 34 in a linear relationship with the cupping arms 28, it is possible to provide a cupping assembly 24 that requires the use of only two actuators to provide the intended function of cooperatively associating or disassociating the unsupported end of the mandrel 22 with an individual cupping arm 28. However, it should be recognized that the cupping arm 28 and any chucking lever 30 cooperatively associated thereto are disposed about the circumference of cupping spider 26 so that an individual cupping arm 28 is cooperatively associated with only one mandrel 22 of turret assembly 20.

An unloading mechanism (not shown) can be started as soon as the cupping arm 28 associated with the mandrel 22 having wound product disposed thereon, has reached the start of hold open portion 44 of track 40. Starting of the unloading mechanism can be coordinated with cupping arm 28 opening in any of several manners. For example, a start signal can be issued after a predetermined delay interval followed by the end of indexing motion. Alternatively, the unloading mechanism can be stopped at the end of each unloading operation in such a position that when restarted for the next operation, the pusher moves substantial distance before coming into engagement with wound product disposed about a mandrel 22 forming the outgoing log. In such a case, the unloading mechanism can be started in operation simultaneously with delivery of the opening input to the unloading station.

As shown in FIGS. 2 and 3, once the cupping arm 28 is engaged with the unsupported end of the mandrel 22 after loading of a core upon mandrel 22 in the loading position, it remains in that position until turret assembly 20 indexes to carry the mandrel 22 out of the loading position. Furthermore, as the mandrel 22 moves away from the loading position and its associated cupping arm 28 is engaged into the hold-closed portion 42 of track 40, the cupping arm 28 is maintained in its engaged position with the now supported end of mandrel 22. The turret assembly (not shown) then indexes the mandrel 22 and associated cupping arm 28 about its longitudinal axis until web product is contactingly engaged with the core disposed upon the mandrel 22. At this point, mandrel 22 is spun up (i.e., rotational inertia is imparted) and as discussed supra coincides with the winding of a web material about the core disposed about mandrel 22 to form a wound product.

Upon reaching the unloading position disposed proximate to the start of hold-open portion 44 of track 40, un-cupping actuator 34 can then be engaged to cupping arm 28 (with or without the use of a chucking lever 30) to retract cupping arm 28 from contacting engagement with a corresponding mandrel 22 and depositing cupping arm 28 into the hold-open portion 44 of track 40. Deposition of cupping arm 28 into the hold-open portion 44 of track 40 then facilitates the mandrel 22 having wound product disposed thereon to be removed from mandrel 22. The cupping arm 28 for the mandrel 22 moving from the unloading position to the loading position remains open in order to clear any required supports. The cupping arm 28 can then freely orbit about the axis of cupping assembly 24 within hold open portion 44 of track 40 in preparation for movement of the next mandrel 22 into the unloading position and egress of ensuing wound product.

By reference, a core may be started onto the mandrel 22 at the loading position by means of a core loading apparatus (not shown) as would be known by those of skill in the art. After the core has run onto the mandrel 22 a known distance, the core can then be engaged by a rotating loading wheel known to those of skill in the art that initially cooperates with the core loading apparatus and moving the core onto the mandrel 22 but which takes over the propulsion of the core in the last part of movement onto the mandrel 22.

Further, as would be known by those of skill in the art, when a core is properly positioned on the mandrel 22, its front end preferably engages in an abutment located near the spider supporting the mandrels 22. After it engages the abutment, the core cannot be advanced any further by the rotating core loading wheel which would then merely slip relative to the core. At about the time that the core engages the abutment, its front end portion moves under an arm that typically comprises a core detector. Such an apparatus may comprise a spring arm having a free end portion that is biased towards contacting engagement with the mandrel 22 at the loading station and a properly loaded core intervenes between the associated spring arm and the mandrel 22 to break contact between them and thus open an electric signal circuit through the spring arm.

As would be understood by those of skill in the art, interruption of the circuit typically comprising an output signifying core presence can cause rotation of the associated core loading wheel to be stopped and engagement of a cupping arm 28 upon the mandrel 22 by operation of the cupping actuator 32 causing the respective chucking lever 30 connected to cupping arm 28 to engage the unsupported end of mandrel 22 having the core disposed thereupon. Such a core presence signal can also be issued to a PCD, PLC, or other synchronizing mechanism for the apparatus and its issuance is in any case a condition or the condition for retraction of the cupping arm 28 at the appropriate position. Such retraction, as pointed out above, constitutes a closing input to the control element for the cupping arm 28 to be positioned back into contacting engagement with its respective mandrel 22. Thus, the cupping arm 28 is in the closed position only if and when a core is present on the mandrel 22 at the loading station and before the mandrel 22 begins to move out of that station.

It should be realized by one of skill in the art that engagement of the cupping arm 28 upon the mandrel 22 could also occur just prior to any core presence signal being detected. It should be recognized that the core should be clear of the cupping arm 28 before the cupping arm 28 moved toward the mandrel 22.

In a preferred embodiment, since the cupping arm 28 can be moved into the closed position where contacting engagement occurs between the cupping arm 28 and the respective mandrel 22 and likely after the mandrel 22 has been subjected to vibration dampening, it is unlikely that the conical end portion typically associated with the mandrel 22 will fail to seat in the bearing socket of the cupping arm 28. However, in the event of such a failure, the cupping actuator 32 can be merely programmed to stop short of its limit position where the cupping arm 28 is closed, thus eliminating damage that can result because the cupping arm 28 will be urged past the stationary mandrel 22 under yielding pressure from cupping actuator 32.

Figure 4:
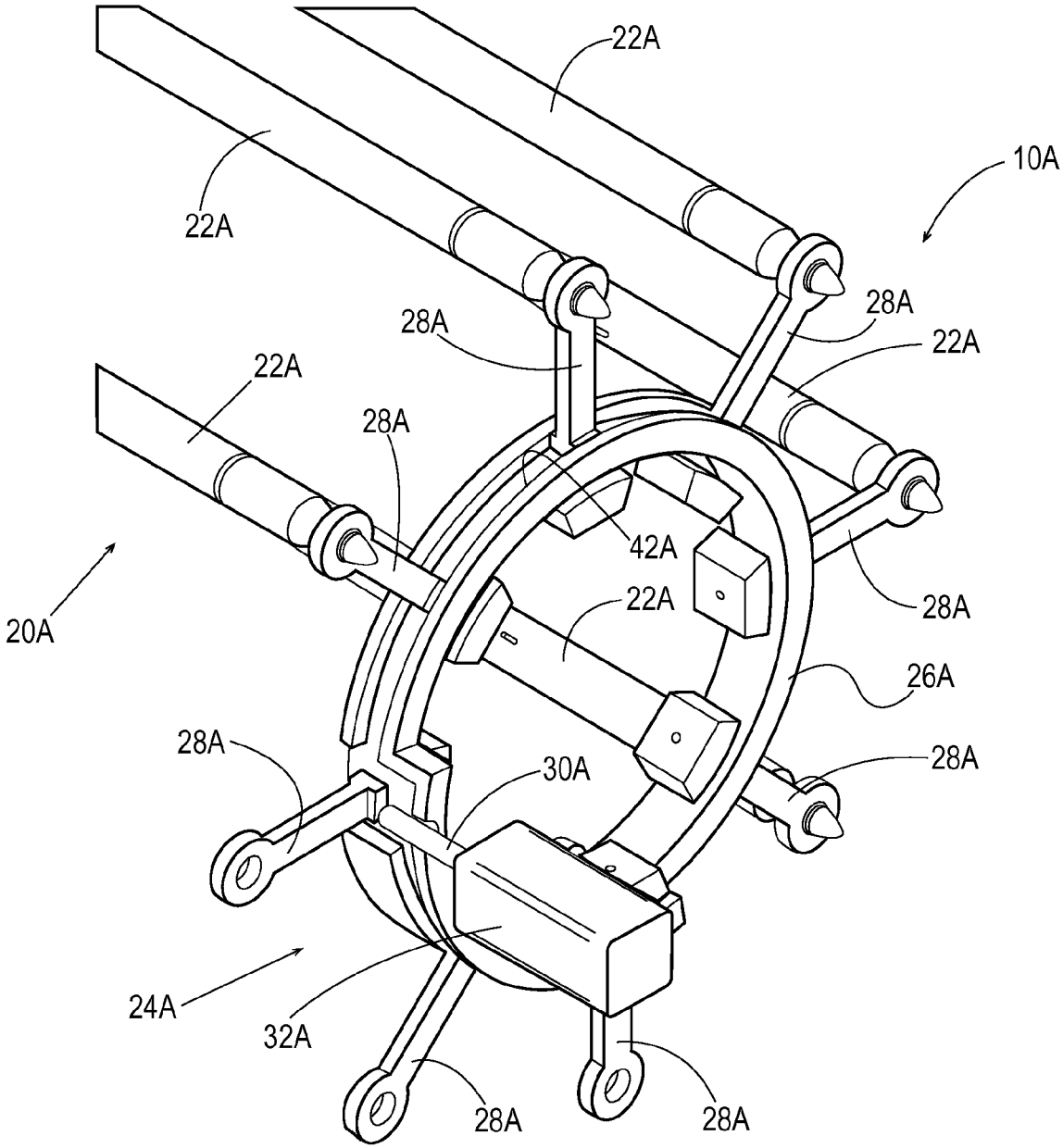
FIG. 4 is a partial perspective view of an exemplary web rewinding machine showing five exemplary mandrels and utilizing another exemplary mandrel cupping assembly.
Figure 5:
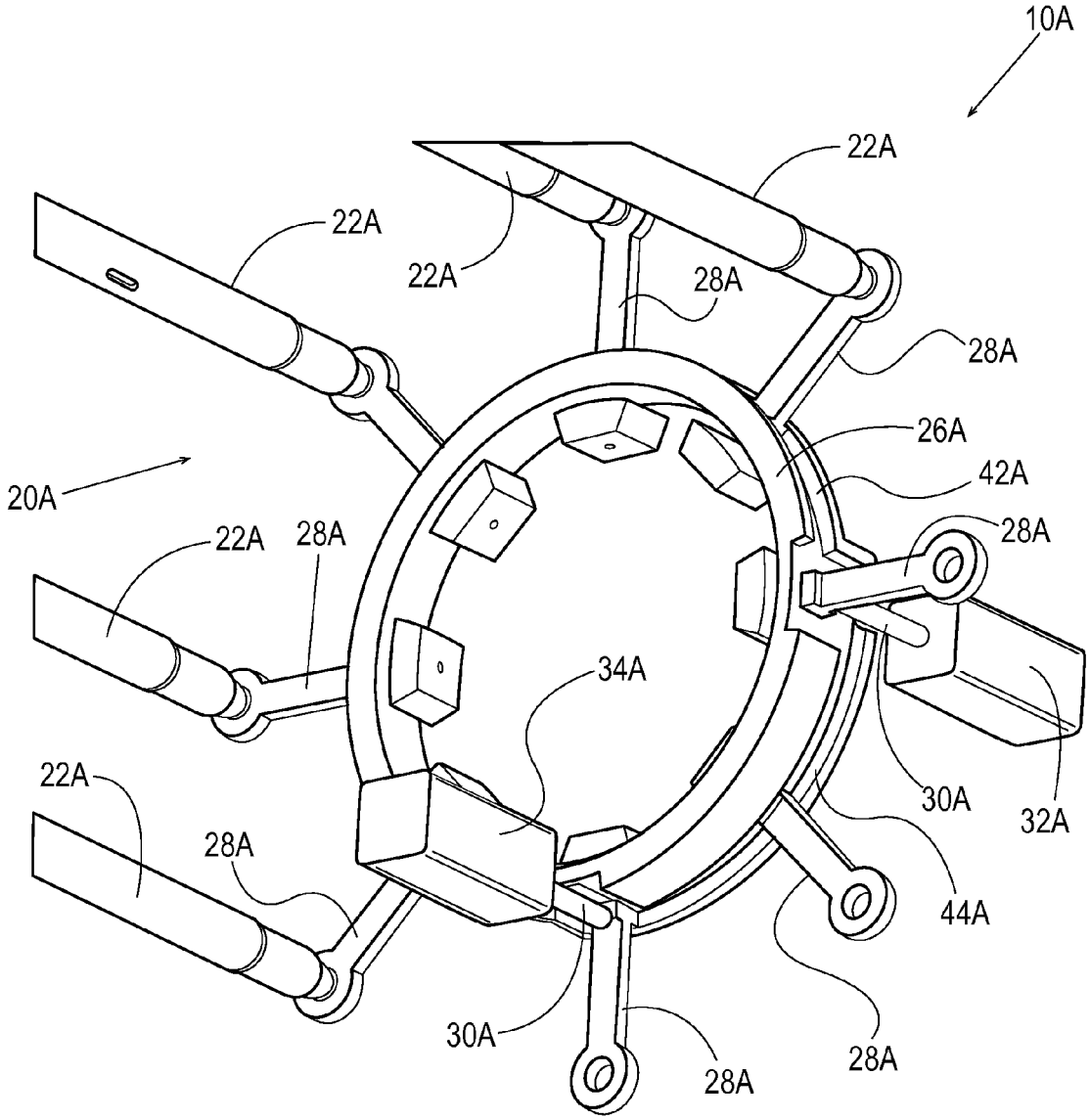
FIG. 5 is an alternative perspective view of the alternative web rewinding machine of FIG. 4; and, FIG. 6 is a planar end view of the exemplary mandrel cupping assembly shown in FIG. 4.
Figure 6:
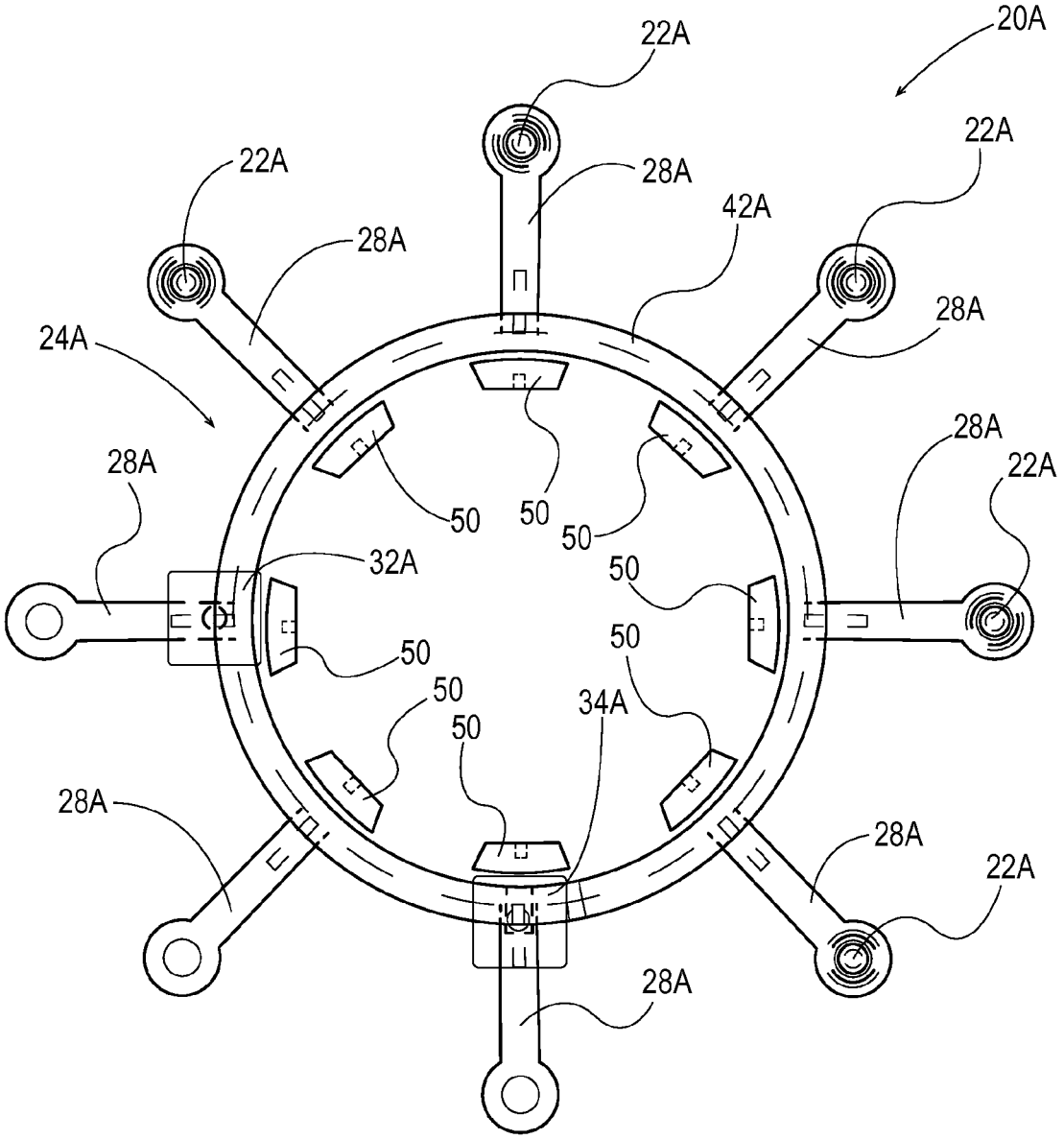

FIGS. 4-6 of the present disclosure depict various perspective and planar views of an alternative exemplary web rewinding machine 10A and the relevant portion of an exemplary, non-limiting embodiment of a turret assembly 20A suitable for use as an automatic web rewinding machine. Similar to the embodiment depicted in FIGS. 1-3 and described supra, a plurality of rotatable core supporting mandrels 22A are carried in an indexable, orbital motion about the axis of turret assembly 20A as well as for rotation about their own respective axes. A typical turret assembly 20A provides a spider (not shown) by which the respective mandrels 22A are carried and a shaft (not shown) by which the spider (not shown) is supported for rotation.

The turret shaft (not shown) projects a substantial distance in one direction from the spider (not shown) and the mandrels 22A disposed thereupon project from the spider (not shown) a somewhat smaller distance in the same direction. One of skill in the art will appreciate that since the rotatable connection between the spider (not shown) and each of the long, relatively heavy mandrels 22A is near one end of the mandrel 22A and the other end of the mandrel 22A will be unsupported at times, the spider (not shown) will typically be provided with two axially spaced apart bearings (not shown) for each mandrel so that the cantilevered connection of the mandrel 22A with the spider (not shown) can, by itself, hold the mandrel 22A reasonably steady. As will be appreciated by one of skill in the art, it is preferred that each mandrel 22A be provided equidistant from the axis of the turret and are uniformly spaced about that axis.

As shown generally in FIGS. 4-6, one of skill in the art will recognize that during both unloading and loading of a mandrel 22A, the end that is remote from the spider must be unsupported. However, as the mandrel moves through the portion of its orbit that takes it from the loading station around to an unloading station, its free end portion is supported by means of a cupping assembly 24A having cupping arm 28A disposed about a cupping spider 26A that are placed into contacting and un-contacting engagement with the free end of the mandrel 22A. In other words, a mandrel cup 28A releaseably engages the unsupported end of a mandrel 22A, and supports the mandrel 22A for rotation of the mandrel 22A about its axis.

In this embodiment, the cupping arm 28A is in an "active" configuration for orbital rotation about cupping spider 26A. It is envisioned that inertia can be provided to a particular cupping arm 28A to allow the cupping arm 28A to orbit cupping spider 26A in the track 40 disposed about cupping spider 26A. By way of non-limiting example, a plurality of electromagnets 50 can be provided within or upon cupping spider 26 that can generate an electromotive force (EMF) sufficient to propel a mandrel 28A to orbit about cupping spider 26A within track 40A. Naturally, one of skill in the art would recognize that other arrangements can be used to provide a particular cupping arm 28A with a motion such as a belt drive, gear drive, and the like. If used, it is believed that the electromagnets 50 can be provided as a plurality of individual electromagnets 50 or as a single linear electromagnet 50.

In any regard it would be possible to provide control programming to cause a particular series of individual electromagnets 50 or a single linear electromagnet 50 to provide the necessary and/or desired motion to each cupping arm 28A necessary to maintain concerted and cooperative alignment with a particular mandrel 22A cooperatively associated thereto while orbiting about cupping spider 26A within track 40A. Such a motion profile can be used to provide each cupping arm 28A with a characteristic motion about cupping spider 26A that may be required at a particular position and/or region of cupping spider 26A.

Any dimensions and values disclosed herein are not to be understood as being strictly limited to the exact dimension and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A mandrel cupping assembly for releaseably engaging unsupported ends of a plurality of mandrels disposed on a web winding turret assembly having a web winding turret assembly axis, each of said plurality of mandrels extending generally parallel to said web winding turret assembly axis, each of said mandrels being driven in a closed mandrel path about said web winding turret assembly axis, said mandrel cupping assembly comprising:

a cupping arm turret having a cupping arm turret central axis;

a cupping arm cooperatively associated with each mandrel of said plurality of mandrels, each of said cupping arms being disposed radially about said cupping arm turret within a track formed in a surface of said cupping arm turret and being capable of releaseably engaging said unsupported end of said mandrel, each of said cupping arms having a hold-open position and a hold-closed position, each cupping arm being carried in a radial orbital path about said cupping arm turret central axis while disposed within said track in either of said hold-open position or said hold-closed position; and, a first actuator for disposing said cupping arm from said hold-open position to said hold-closed position.

2. The mandrel cupping assembly of claim 1 wherein disposing said cupping arm from said hold-open position to said hold-closed position further comprises engaging said cupping arm with said mandrel cooperatively associated thereto.

3. The mandrel cupping assembly of claim 2 further comprising a second actuator for disposing said cupping arm from said hold-closed position to said hold-open position.

4. The mandrel cupping assembly of claim 3 wherein disposing said cupping arm from said hold-closed position to said hold-open position further comprises disengaging said cupping arm from said mandrel cooperatively associated thereto.

5. The mandrel cupping assembly of claim 1 further comprising a second actuator for disposing said cupping arm from said hold-closed position to said hold-open position.

6. The mandrel cupping assembly of claim 5 wherein disposing said cupping arm from said hold-closed position to said hold-open position further comprises disengaging said cupping arm from said mandrel cooperatively associated thereto.

7. The mandrel cupping assembly of claim 5 further comprising a chucking lever cooperatively associated with said second actuator, said chucking lever providing contacting engagement between said second actuator and a respective cupping arm to displace said cupping arm from said hold-closed position to said hold-open position.

8. The mandrel cupping assembly of claim 1 further comprising a chucking lever cooperatively associated with said first actuator, said chucking lever providing contacting engagement between said first actuator and a respective cupping arm to displace said cupping arm from said hold-open position to said hold-closed position.

9. The mandrel cupping assembly of claim 1 further comprising a second actuator for disposing said cupping arm from said hold-closed position to said hold-open position and a chucking lever cooperatively associated with each of said cupping arms, each of said chucking levers providing connective engagement of each respective cupping arm with either of said first or second actuators when said respective cupping arm is proximate either of said first or second actuator.

10. The mandrel cupping assembly of claim 1 wherein said cupping arm is indexably rotatable about said radial path.

11. The mandrel cupping assembly of claim 10 wherein said cupping arm is manually advanceable from a first position to a second position about said radial path.

12. The mandrel cupping assembly of claim 1 wherein said first actuator is fixably disposed upon said cupping arm turret relative to said hold-open position.

13. The mandrel cupping assembly of claim 1 wherein said cupping arm cooperatively associated with each mandrel dwells in each of a plurality of positions about said cupping arm turret.

14. The mandrel cupping assembly of claim 13 wherein one of said plurality of positions provides for disposition of a core upon one of said plurality of mandrels when said cupping arm is disposed in said hold-open position.

15. The mandrel cupping assembly of claim 14 wherein a second of said plurality of positions provides for disposition of a web substrate upon said core when said cupping arm is disposed in said hold-closed position.

16. The mandrel cupping assembly of claim 15 wherein at least one of said plurality of positions provides for removal of said core and said web substrate disposed thereabout when said cupping arm is disposed in said hold-open position.

* * * * *